US011192381B2

(12) United States Patent
Tajima et al.

(10) Patent No.: US 11,192,381 B2
(45) Date of Patent: Dec. 7, 2021

(54) LIQUID EJECTION APPARATUS AND LIQUID FILLING METHOD

(71) Applicant: CANON KABUSHIKI KAISHA, Tokyo (JP)

(72) Inventors: Hiroki Tajima, Yokohama (JP); Keiichiro Tsukuda, Yokohama (JP); Kenji Yabe, Yokohama (JP); Yuji Tamaru, Tokyo (JP); Naoko Shimizu, Kawasaki (JP); Kyosuke Toda, Kawasaki (JP); Sayaka Seki, Kawasaki (JP); Yosuke Takagi, Yokohama (JP); Shimpei Yoshikawa, Yokohama (JP); Ryo Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/804,223

(22) Filed: Feb. 28, 2020

(65) Prior Publication Data

US 2020/0290362 A1 Sep. 17, 2020

(30) Foreign Application Priority Data

Mar. 15, 2019 (JP) ..... JP2019-048488

(51) Int. Cl.
*B41J 2/175* (2006.01)

(52) U.S. Cl.
CPC ..... *B41J 2/17509* (2013.01); *B41J 2/17506* (2013.01); *B41J 2/17596* (2013.01)

(58) Field of Classification Search
CPC . B41J 2/17509; B41J 2/17506; B41J 2/17596
See application file for complete search history.

(56) References Cited

U.S. PATENT DOCUMENTS

| | | | | |
|---|---|---|---|---|
| 5,430,471 | A | 7/1995 | Nakajima et al. | 347/87 |
| 5,504,511 | A | 4/1996 | Nakajima et al. | 347/86 |
| 5,583,549 | A | 12/1996 | Ujita et al. | 347/86 |
| 5,589,862 | A | 12/1996 | Ujita et al. | 347/87 |
| 5,604,523 | A | 2/1997 | Tsukuda et al. | 347/86 |
| 5,608,437 | A | 3/1997 | Iwata et al. | 347/86 |
| 5,619,237 | A | 4/1997 | Inoue et al. | 347/86 |

(Continued)

FOREIGN PATENT DOCUMENTS

JP 4687063 B2 5/2011

OTHER PUBLICATIONS

U.S. Appl. No. 16/728,460, filed Dec. 27, 2019.
U.S. Appl. No. 16/720,723, filed Dec. 19, 2019.

*Primary Examiner* — Justin Seo
(74) *Attorney, Agent, or Firm* — Venable LLP

(57) ABSTRACT

A liquid ejection apparatus includes: a recording head that ejects liquid; a sub-tank that is connected to the recording head and temporarily stores the liquid to be supplied to the recording head; a liquid tank that communicates with the sub-tank and is able to be filled with the liquid; a first atmosphere opening unit that is provided in the liquid tank; and a second atmosphere opening unit that is provided in the sub-tank. The second atmosphere opening unit is closable when the liquid tank is filled with the liquid, and the first atmosphere opening unit and the second atmosphere opening unit are able to open the liquid tank and the sub-tank to the atmosphere, respectively, when the sub-tank is filled with the liquid filled in the liquid tank by a hydraulic head pressure.

7 Claims, 8 Drawing Sheets

(56) References Cited

U.S. PATENT DOCUMENTS

| | | | | |
|---|---|---|---|---|
| 5,701,995 | A | 12/1997 | Higuma et al. | 206/205 |
| 5,742,309 | A | 4/1998 | Tajima et al. | 347/86 |
| 5,781,213 | A | 7/1998 | Ujita et al. | 347/86 |
| 5,784,088 | A | 7/1998 | Ujita et al. | 347/86 |
| 5,900,889 | A | 5/1999 | Tsukuda | 347/23 |
| 5,988,804 | A | 11/1999 | Kotaki et al. | 347/87 |
| 6,045,218 | A | 4/2000 | Tajima et al. | 347/86 |
| 6,102,533 | A | 8/2000 | Nozawa et al. | 347/86 |
| 6,152,555 | A | 11/2000 | Nozawa et al. | 347/49 |
| 6,170,939 | B1 | 1/2001 | Ujita et al. | 347/86 |
| 6,179,415 | B1 | 1/2001 | Okazaki et al. | 347/86 |
| 6,179,416 | B1 | 1/2001 | Ikeda et al. | 347/86 |
| 6,234,615 | B1 | 5/2001 | Tsukuda | 347/85 |
| 6,250,752 | B1 | 6/2001 | Tajima et al. | 347/92 |
| 6,264,315 | B1 | 7/2001 | Nozawa et al. | 347/86 |
| 6,286,944 | B1 | 9/2001 | Shimizu et al. | 347/86 |
| 6,336,709 | B1 | 1/2002 | Inoue et al. | 347/49 |
| 6,338,546 | B1 | 1/2002 | Kotaki et al. | 347/49 |
| 6,361,158 | B1 | 3/2002 | Inoue et al. | 347/86 |
| 6,431,681 | B2 | 8/2002 | Hatasa et al. | 347/19 |
| 6,454,399 | B2 | 9/2002 | Ujita et al. | 347/86 |
| 6,565,199 | B2 | 5/2003 | Ujita et al. | 347/86 |
| 6,631,982 | B2 | 10/2003 | Sasaki et al. | 347/85 |
| 6,783,220 | B2 | 8/2004 | Ujita et al. | 347/87 |
| 6,805,437 | B2 | 10/2004 | Yamanaka et al. | 347/92 |
| 6,815,381 | B1 | 11/2004 | Yamamoto et al. | 442/187 |
| 6,851,795 | B2 | 2/2005 | Watanabe et al. | 347/50 |
| 6,945,643 | B2 | 9/2005 | Tajima et al. | 347/87 |
| 7,044,588 | B2 | 5/2006 | Tajima et al. | 347/85 |
| 7,293,865 | B2 | 11/2007 | Tsukuda et al. | 347/86 |
| 7,384,129 | B2 | 6/2008 | Nagata et al. | 347/43 |
| 7,401,909 | B2 | 7/2008 | Inoue et al. | 347/86 |
| 7,407,274 | B2 | 8/2008 | Inoue et al. | 347/86 |
| 7,407,275 | B2 | 8/2008 | Inoue et al. | 347/86 |
| 7,914,137 | B2 | 3/2011 | Inoue et al. | 347/86 |
| 8,025,382 | B2 | 9/2011 | Tajima | 347/87 |
| 8,425,022 | B2 | 4/2013 | Inoue et al. | 347/86 |
| 9,321,274 | B2 | 4/2016 | Takagi et al. | B41J 2/17526 |
| 9,597,884 | B2 | 3/2017 | Nanjo et al. | B41J 2/17513 |
| 9,738,081 | B2 | 8/2017 | Kimura et al. | B41J 2/17513 |
| 9,821,562 | B2 | 11/2017 | Nanjo et al. | B41J 2/17513 |
| 9,840,082 | B2 | 12/2017 | Nanjo et al. | B41J 2/17553 |
| 9,962,945 | B2 | 5/2018 | Takaoka et al. | B41J 2/17506 |
| 9,981,477 | B2 | 5/2018 | Fukuchi et al. | B41J 2/175 |
| 9,981,478 | B2 | 5/2018 | Ikebe et al. | B41J 2/175 |
| 10,118,396 | B2 | 11/2018 | Kimura et al. | B41J 2/17596 |
| 10,207,511 | B2 | 2/2019 | Nanjo et al. | B41J 2/17526 |
| 2011/0199407 | A1* | 8/2011 | Kaiho | B41J 25/003 347/9 |

* cited by examiner

LIQUID EJECTION APPARATUS AND LIQUID FILLING METHOD

BACKGROUND OF THE INVENTION

Field of the Invention

The present invention relates to a liquid ejection apparatus and a liquid filling method, and more particularly to a configuration for filling a sub-tank of the liquid ejection apparatus with liquid.

Description of the Related Art

In an ink jet recording apparatus, as recording is performed, ink replenishment is required. In recent years, a recording apparatus capable of supplying ink directly to an ink tank has been used to reduce running costs and ink replacement frequency. In such a recording apparatus, a sub-tank for temporarily storing a certain amount of ink may be provided between a recording head and the ink tank. The ink tank and the sub-tank are connected by a tube.

In order to initially fill the sub-tank with ink, a suction method which is called choke suction may be employed. The choke suction is performed in the following procedure. First, the tube is partially closed by a choke mechanism provided in the tube, and in this state, a pressure of a downstream side of the choke mechanism of the tube is made negative by suction. Thereafter, an ink supply pressure is rapidly increased to open the choke mechanism. As a result, ink staying in the tube is discharged from an ejection port at once, and the sub-tank is filled with ink. Japanese Patent No. 4687063 discloses an example in which the choke suction is applied to a restoring operation of the ejection port.

SUMMARY OF THE INVENTION

A liquid ejection apparatus includes: a recording head that ejects liquid; a sub-tank that is connected to the recording head and temporarily stores the liquid to be supplied to the recording head; a liquid tank that communicates with the sub-tank and is able to be filled with the liquid; a first atmosphere opening unit that is provided in the liquid tank; and a second atmosphere opening unit that is provided in the sub-tank. The second atmosphere opening unit is closable when the liquid tank is filled with the liquid, and the first atmosphere opening unit and the second atmosphere opening unit are able to open the liquid tank and the sub-tank to the atmosphere, respectively, when the sub-tank is filled with the liquid filled in the liquid tank by a hydraulic head pressure.

Further features of the present invention will become apparent from the following description of exemplary embodiments with reference to the attached drawings.

DESCRIPTION OF THE EMBODIMENTS

In a case of filling the sub-tank with ink by using the choke suction, it is necessary to rapidly increase the ink supply pressure before opening the choke mechanism. This leads to an increase in cost due to complicated control mechanisms or structures.

An object of the present invention is to provide a liquid ejection apparatus capable of filling a sub-tank with liquid by using a simple mechanism.

Hereinafter, several embodiments of a liquid ejection apparatus of the present invention will be described with reference to the drawings. A liquid ejection apparatus according to the present embodiment is an ink jet recording apparatus (hereinafter, referred to as a recording apparatus 1) that prints photographs, characters, and the like by ejecting ink onto a recording medium such as paper. However, the present invention is not limited thereto, and can also be applied to a liquid ejection apparatus that ejects liquid other than ink, such as a 3D printer.

First Embodiment

Figure 1:
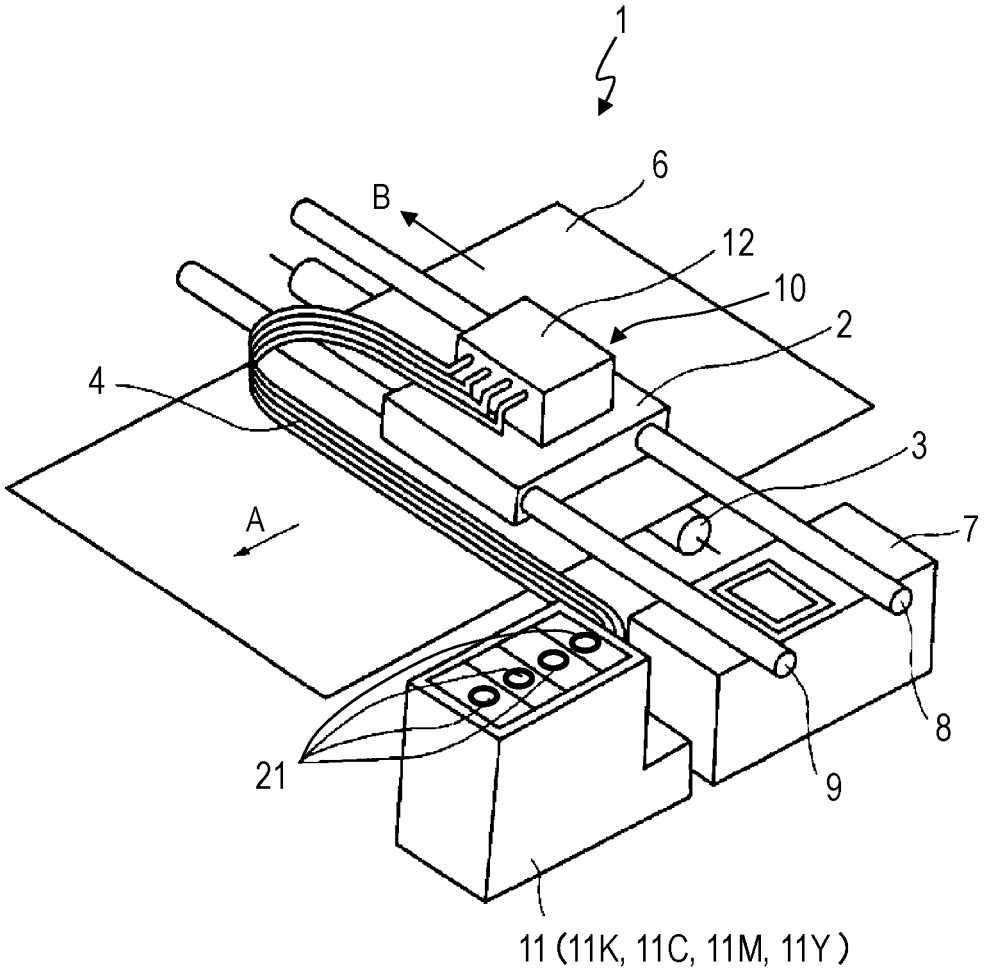
FIG. 1 is a schematic view of a recording apparatus according to a first embodiment of the present invention.

FIG. 1 is a schematic view of a recording apparatus 1 according to a first embodiment of the present invention. The recording apparatus 1 includes a carriage 2, a transport roller 3, a tube 4, a cap unit 7, a first shaft 8, a second shaft 9, a recording head 10, a liquid tank 11, and a sub-tank 12. The recording head 10 and the sub-tank 12 are provided on the carriage 2, and the liquid tank 11 is provided in a main body portion of the recording apparatus 1. A recording medium 6 is moved in a feeding direction A of the recording medium 6 by the transport roller 3. In synchronization with this movement, the recording head 10 supported by the carriage 2 performs printing on the recording medium 6 while reciprocating along the first shaft 8 and the second shaft 9. The recording head 10 is connected to the liquid tank 11 by the tube 4 via the sub-tank 12, and ink is supplied from the liquid tank 11 to the recording head 10. The liquid tank 11 is constituted by four liquid tanks 11K, 11C, 11M, and 11Y of black, cyan, magenta, and yellow, and each of the liquid tanks 11K, 11C, 11M, and 11Y is provided with a first atmosphere opening unit 21. Note that the number of colors of the liquid tank 11 is not limited to four, and may be any number.

FIGS. 2A to 2D are each a schematic view illustrating the recording head 10, the liquid tank 11, the sub-tank 12, and an ink supply path of the recording apparatus 1 illustrated in FIG. 1, and illustrate an initial ink filling process in a time-series manner. The recording head 10 includes an energy-generating element (not illustrated) which gives energy for ejection to the ink, and an ejection port 15A from which the ink is ejected. The energy-generating element is formed by using, for example, a heater or a piezoelectric element. An ejection port forming surface 15B in which the ejection port 15A is formed faces the recording medium 6. The recording head 10 stands by at a position of the cap unit 7 when the recording apparatus 1 is stopped and is in a stand-by state, and the ejection port forming surface 15B is sealed with a cap 16. As a result, drying of inside of the ejection port 15A or ink leakage from the ejection port 15A is prevented.

The liquid tank 11 includes a liquid chamber 13 in which the ink is stored, and a buffer chamber 14 for controlling a pressure of the liquid chamber 13. The buffer chamber 14 is provided at a lower portion of the liquid tank 11, and is connected to the liquid chamber 13 through a gas-liquid exchange port 17 which interrupts a flow of ink and allows only propagation of pressure. The gas-liquid exchange port 17 is provided in a side surface of the buffer chamber 14. A bottom portion of the gas-liquid exchange port 17 is located on a level lower than that of the ejection port forming surface 15B, and as a pressure of the buffer chamber 14 is set to an atmospheric pressure, a pressure of the ejection port forming surface 15B can be maintained negative when the recording apparatus 1 is operated. The gas-liquid exchange port 17 is implemented by a rectangular opening having a size of, for example, about 1 mm×1.6 mm, in consideration of the balance between a pressure loss (a pressure loss that does not cause insufficient ink supply) during ink supply and an appropriate meniscus force.

The liquid chamber 13 of the liquid tank 11 can be filled with ink filled in an ink bottle 31 or the like. An ink filling port 28 into which a tip end of the ink bottle 31 is inserted is provided in an upper surface of the liquid chamber 13. The ink filling port 28 can be closed by a first plug 24, and the first plug 24 is removed at the time of the ink filling.

The sub-tank 12 temporarily stores ink to be supplied to the recording head 10. The sub-tank 12 is connected to the recording head 10 and communicates with the liquid chamber 13 of the liquid tank 11 through the tube 4. The tube 4 is connected to the liquid chamber 13 at a lower portion of the liquid chamber 13. According to the present embodiment, the tube 4 is connected at a side of the buffer chamber 14. The sub-tank 12 is located beside the liquid tank 11, and an upper surface of the sub-tank 12 is lower than an upper surface of the liquid tank 11. Since the sub-tank 12 is mounted on the carriage 2, a capacity thereof is set to a necessary minimum capacity. The ink is replenished from the liquid tank 11 to the sub-tank 12 through the tube 4 during recording.

The first atmosphere opening unit 21 is provided in the liquid tank 11. According to the present embodiment, the first atmosphere opening unit 21 is a first valve 21 provided in the upper surface of the liquid chamber 13. A second atmosphere opening unit 22 is provided in the sub-tank 12. According to the present embodiment, the second atmosphere opening unit 22 is a second valve 22 provided in the upper surface of the sub-tank 12. The first valve 21 and the second valve 22 can open each of the liquid tank 11 and the sub-tank 12 to the atmosphere when the sub-tank 12 is filled with the ink filled in the liquid tank 11 by a hydraulic head pressure. The second valve 22 can be closed when the liquid tank 11 is filled with ink. A third atmosphere opening unit 23 is provided in the buffer chamber 14. According to the present embodiment, the third atmosphere opening unit 23 is a third valve 23 provided in a side surface of the buffer chamber 14 that is opposite to the side surface in which the gas-liquid exchange port 17 is provided.

Figure 2A:
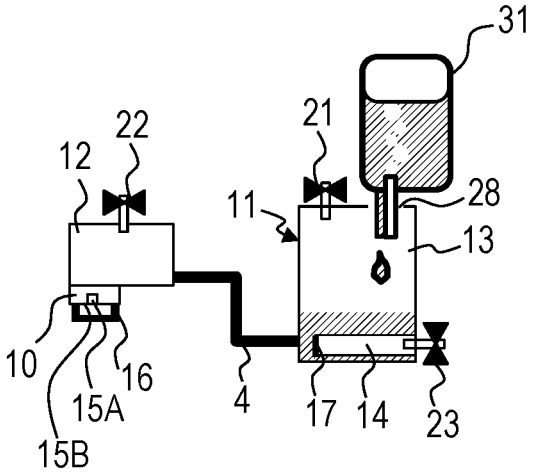
FIGS. 2A, 2B, 2C and 2D are each a schematic view of an ink supply path according to the first embodiment of the present invention.

Next, a method for initially filling the sub-tank 12 with ink will be described. When the recording apparatus 1 is started, first, the empty liquid chamber 13 of the liquid tank 11 is filled with ink as illustrated in FIG. 2A. Specifically, the first plug 24 of the liquid chamber 13 is removed, and the tip end of the ink bottle 31 is inserted into the ink filling port 28. A gap for exhausting air is formed between the ink filling port 28 and the tip end of the ink bottle 31. As a method for filling ink, a method in which the liquid chamber 13 is filled with ink directly from the ink bottle 31 is generally used. However, it is also possible to indirectly fill the liquid chamber 13 with the ink by inserting a tube or a pipe into the ink filling port 28. At the time of the ink filling, the ejection port forming surface 15B is covered with the cap 16, and the first to third valves 21 to 23 are closed. However, at this point of time, the first valve 21 may be opened. Since the second valve 22 is closed, after a liquid level of the ink reaches a connection portion of the liquid chamber 13 where the liquid chamber 13 and the tube 4 are connected to each other, that is, after an opening of the connection portion is blocked with the ink, the air inside the sub-tank 12 is trapped in the sub-tank 12 and is not exhausted. Accordingly, even in a case where the ink filling is continued, the ink does not flow into the sub-tank 12, and only the liquid chamber 13 is filled with the ink.

Figure 2B:
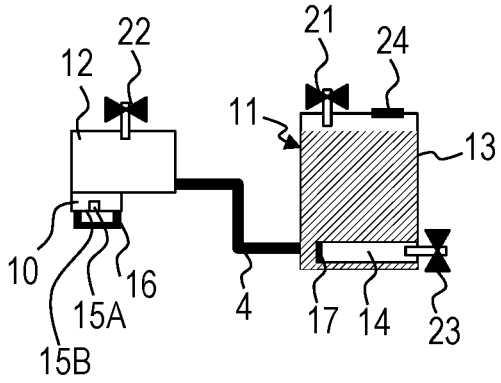

FIG. 2B illustrates a state in which the ink filling is completed. The completion of the ink filling can be known, for example, when an operator visually confirms that the liquid level of the ink reaches a mark provided in the liquid tank 11. It is preferable that the liquid chamber 13 is fully filled with the ink. However, it is sufficient that the ink is filled at least to a position higher than a bottom surface of the sub-tank 12. Once the filling of the liquid tank 11 with the ink is completed, the ink filling port 28 is sealed with the first plug 24.

Figure 2C:
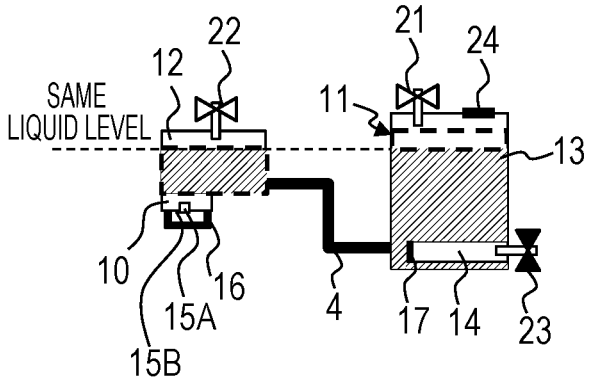

Next, as illustrated in FIG. 2C, the first valve 21 is opened to open the liquid tank 11 to the atmosphere, and the second valve 22 is opened to open the sub-tank 12 to the atmosphere. As a result, ink surrounded by a broken line is moved from the liquid tank 11 to the sub-tank 12 due to a hydraulic head pressure, such that the liquid level of the ink in the liquid tank 11 and a liquid level of the ink in the sub-tank 12 coincide with each other. In other words, in a state in which the liquid tank 11 and the sub-tank 12 are opened to the atmosphere by the first valve 21 and the second valve 22, respectively, the sub-tank 12 is filled with the ink filled in the liquid tank 11 by a hydraulic head pressure caused by the ink in the liquid tank 11. Since a positive pressure is applied to the ejection port 15A, the ink may leak from the ejection port 15A. However, the ink leaked from the ejection port 15A is held in a space between the cap 16 and the ejection port forming surface 15B.

Figure 2D:
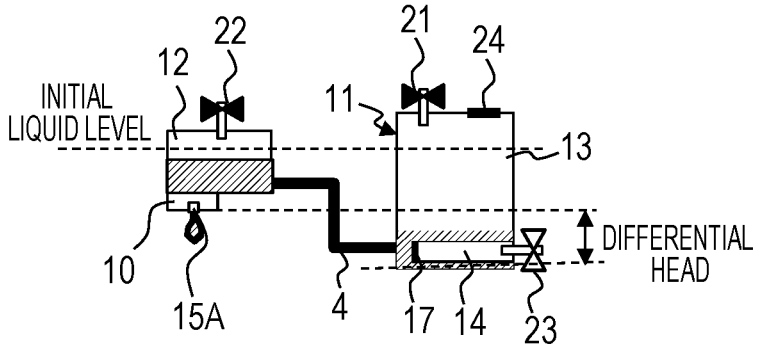

Next, as illustrated in FIG. 2D, the first and second valves 21 and 22 are closed, and the third valve 23 is opened. More precisely, after the sub-tank 12 is filled with ink, the first and second valves 21 and 22 are closed, and then the third valve 23 is opened. The reason is as follows. In a state in which the first and second valves 21 and 22 are opened and the third valve 23 is closed, a pressure at which the liquid level reaches a level when the atmospheric pressure is applied is applied to the ink in the liquid chamber 13 of the liquid tank 11 and the sub-tank 12. In particular, since the gas-liquid exchange port 17 is located on a level lower than that of the ejection port forming surface 15B, a large pressure is applied. However, since there is almost no pressure difference between opposite sides of the gas-liquid exchange port 17, an excessive differential pressure is not applied to the gas-liquid exchange port 17. When the third valve 23 is opened in this state, a large pressure is applied to the side of the gas-liquid exchange port 17 that faces the liquid chamber 13, while a pressure of the side of the gas-liquid exchange port 17 that faces the buffer chamber 14 is the atmospheric pressure. Therefore, the gas-liquid exchange port 17 may be destroyed due to a pressure difference, and the ink may flow out from the third valve 23. In contrast, when the third valve 23 is opened in a state in which the first and second valves 21 and 22 are closed, a pressure applied to the opposite sides of the gas-liquid exchange port 17 is the atmospheric pressure. Therefore, in this process, the first and second valves 21 and 22 are closed and then the third valve 23 is opened. Any one of the first valve 21 and the second valve 22 may be opened first, or the first valve 21 and the second valve 22 may be opened simultaneously. The first to third valves 21 to 23 may be manually operated by the user, or may be operated by an electronic control using a sensor, a timer, or the like.

The ink filling operation is terminated through the above-described process, and the recording apparatus 1 becomes ready for printing. As the third valve 23 is opened, the pressure of the buffer chamber 14 becomes the atmospheric pressure, and a negative pressure is applied to the ejection port forming surface 15B. As a result, even if the ink leaks into the space between the cap 16 and the ejection port forming surface 15B in the process illustrated in FIG. 2C, the ink returns into the recording head 10 by the negative pressure, such that the ink does not leak even when the cap 16 is removed. Since the meniscus of the ejection port 15A is appropriately formed and maintained, ink leakage during printing can be suppressed. The cap 16 is preferably removed immediately before starting printing. Thereafter, once the printing is started, the ink in the sub-tank 12 is consumed. Since the second valve 22 is closed and a connection portion of the liquid tank 11 where the liquid tank 11 and the tube 4 are connected to each other is also sealed with the ink, air in the sub-tank 12 does not escape from the tube 4 into the liquid tank 11. Therefore, when the ink in the sub-tank 12 is consumed, the same amount of ink as the consumed ink is replenished from the liquid tank 11, and the amount of ink in the sub-tank 12 remains basically constant. However, the liquid level may be slightly reduced due to evaporation of the ink in the sub-tank 12, mixing of bubbles in the tube 4, or the like.

When the ink in the liquid tank 11 is consumed and refilling with ink is performed, the above-described process is repeated. Specifically, first, the third valve 23 is closed, the ejection port forming surface 15B is sealed with the cap 16, and the first plug 24 of the ink filling port 28 is removed to obtain the state illustrated in FIG. 2A. Thereafter, the ink is filled from the ink filling port 28, and the above-described process is repeated.

According to the above-described configuration, when the sub-tank 12 is initially filled with ink, the ink in the liquid tank 11 can fill the sub-tank 12 by the hydraulic head pressure without performing the choke suction. For this reason, it is possible to achieve cost reduction resulting from the more simplified ink supply system as compared with a configuration in which the choke suction is performed. In addition, in a case of performing the choke suction, a large amount of ink may temporarily leak from the ejection port. However, in the present embodiment, since the choke suction is unnecessary, it is possible to reduce the amount of waste ink during ink filling.

Further, a filter (not illustrated) for removing dust contained in the ink may be installed upstream of the ejection port 15A inside the recording head 10. When the choke suction is performed, air is easily mixed into the ink, and minute bubbles are likely to be generated on a surface of the filter when the mixed flow of ink and air passes through the filter. This bubble reduces printing quality, and in some cases, causes an ink ejection failure. In the present embodiment, since a rapid ink flow such as the choke suction does not occur, bubbles are not easily generated, and deterioration in printing quality can be suppressed.

Second Embodiment

Figure 3:
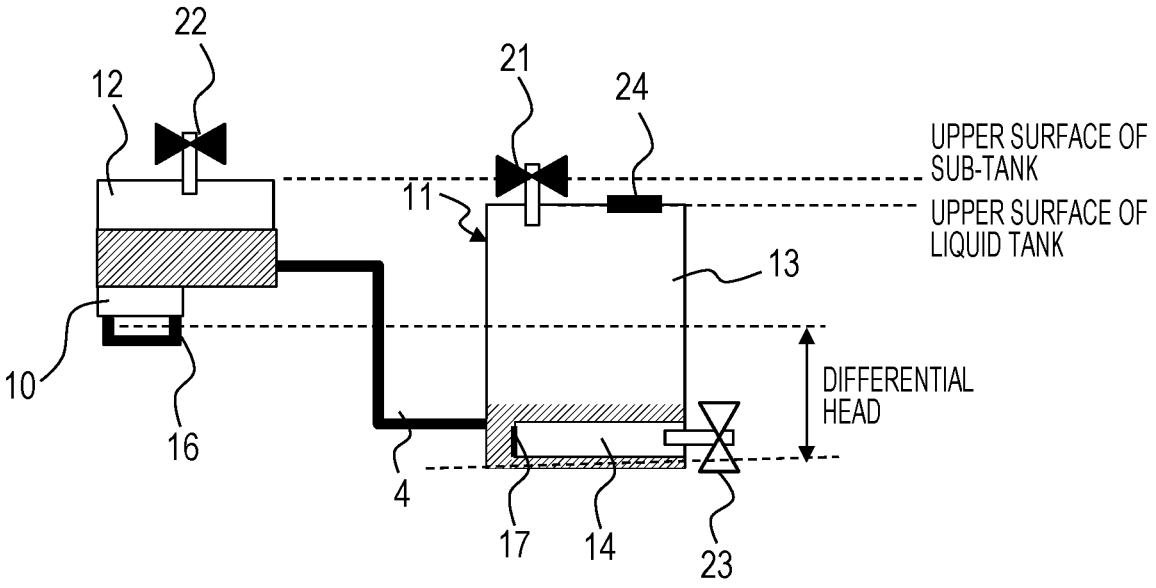
FIG. 3 is a schematic view of an ink supply path according to a second embodiment of the present invention.

FIG. 3 is a schematic view illustrating a second embodiment of the present invention. A description of the same configuration as that of the first embodiment will be omitted, and a description will be made focusing on differences from the first embodiment. As described above, as the first and second valves 21 and 22 are opened and the liquid tank 11 and the sub-tank 12 are opened to the atmosphere, the liquid level of the ink in the liquid tank 11 coincides with the liquid level of the ink in the sub-tank 12. However, in a case where a maximum liquid filling height of the sub-tank 12 or the upper surface of the sub-tank 12 is at a low position, the liquid level in the sub-tank 12 may reach the maximum liquid filling height of the sub-tank 12 or the upper surface of the sub-tank 12 before the liquid level of the ink in the liquid tank 11 and the liquid level of the ink in the sub-tank 12 coincide with each other. As a result, the ink may leak from the second valve 22.

In the present embodiment, the upper surface of the liquid tank 11, that is, a maximum liquid filling height of the liquid tank 11 is set to be lower than the maximum liquid filling height of the sub-tank 12 or the upper surface of the sub-tank 12. Therefore, the liquid level of the ink in the liquid tank 11 and the liquid level of the ink in the sub-tank 12 coincide with each other always below the maximum liquid filling height of the sub-tank 12 or below the upper surface of the sub-tank 12. In other words, the ink moved from the liquid tank 11 to the sub-tank 12 surely fills the sub-tank 12 without leaking from the second valve 22, it is possible to prevent a leakage of the ink from the sub-tank 12 and improve reliability of the recording apparatus 1.

Third Embodiment

FIGS. 4A to 4D are each a schematic view illustrating a third embodiment of the present invention and illustrate an initial ink filling process in a time-series manner, similarly to FIG. 3. A description of the same configuration as that of the first embodiment will be omitted, and a description will be made focusing on differences from the first embodiment. A first valve 21 (first atmosphere opening unit) having the same configuration as that of the first embodiment and a joint 32 for ink filling are provided in the upper surface of the liquid chamber 13. The joint 32 passes through the ink filling port 28 provided in the upper surface of the liquid chamber 13 of the liquid tank 11, and communicates with an external liquid filling unit such as the ink bottle 31 at the time of the ink filling. The joint 32 includes a liquid inflow path 33 through which the ink flows in and an air exhaust path 34 through which air inside the liquid tank 11 is exhausted. The liquid inflow path 33 extends to a level lower than that of the air exhaust path 34. The upper surface of the sub-tank 12 is at a position lower than the upper surface of the liquid tank 11 and higher than a lower end of the air exhaust path 34.

Figure 4A:
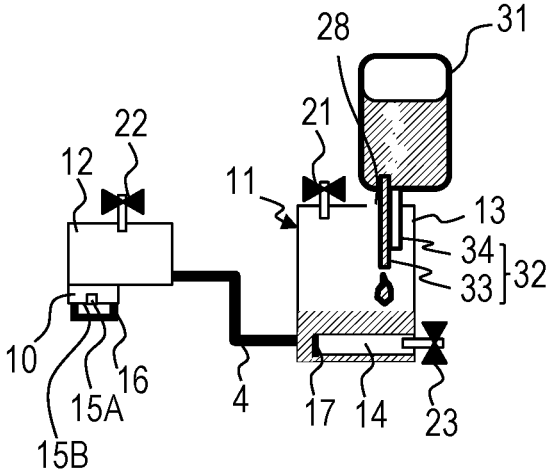
FIGS. 4A, 4B, 4C and 4D are each a schematic view of an ink supply path according to a third embodiment of the present invention.
Figure 5A:
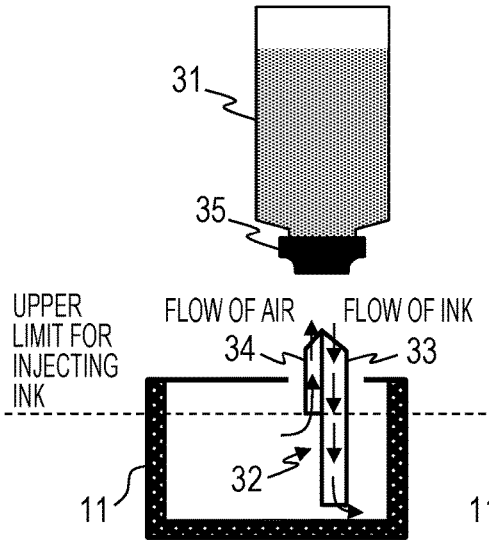
FIGS. 5A, 5B and 5C are each a schematic view of an automatic ink filling stop mechanism according to the third embodiment.
Figure 5B:
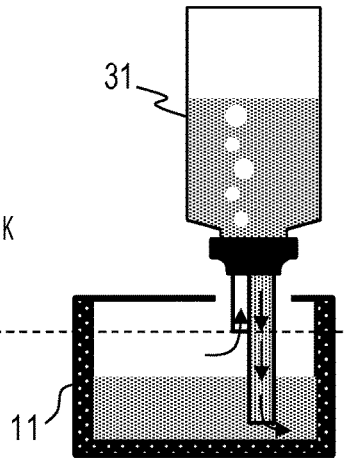
Figure 5C:
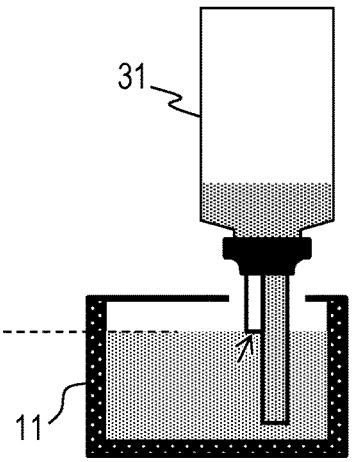

Next, a method for initially filling the sub-tank 12 with ink will be described. When the recording apparatus 1 is started, first, the empty liquid chamber 13 of the liquid tank 11 is filled with the ink as illustrated in FIG. 4A. In the present embodiment, a mechanism for automatically stopping the ink filling into the liquid chamber 13 is provided. An operation principle of this mechanism will be described with reference to FIGS. 5A to 5C. Referring to FIG. 5A, the ink bottle 31 is located above the joint 32. A rubber cap 35 is provided at the tip end of the ink bottle 31. A slit (not illustrated) through which the joint 32 can be inserted is formed in the cap 35, but the slit is normally closed and thus the ink does not leak from the ink bottle 31. Next, as illustrated in FIG. 5B, the ink bottle 31 is lowered and connected to the joint 32. The joint 32 is inserted through the slit of the cap 35. As the air in the liquid tank 11 is replaced with the ink in the ink bottle 31, the liquid tank 11 is filled with the ink. When the ink in the liquid tank 11 reaches the lower end of the air exhaust path 34, the air exhaust path 34 is blocked as illustrated in FIG. 5C, and the ink filling automatically stops.

Figure 4B:
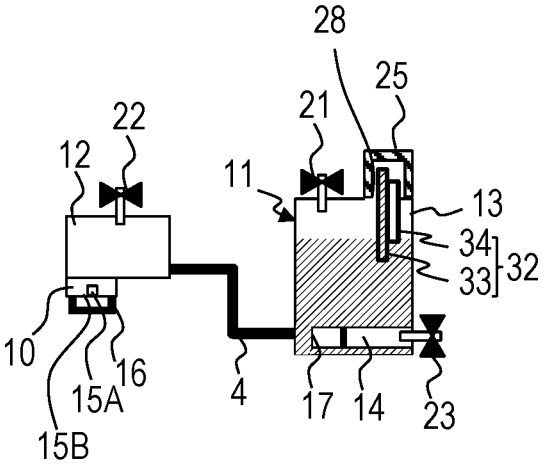
Figure 4C:
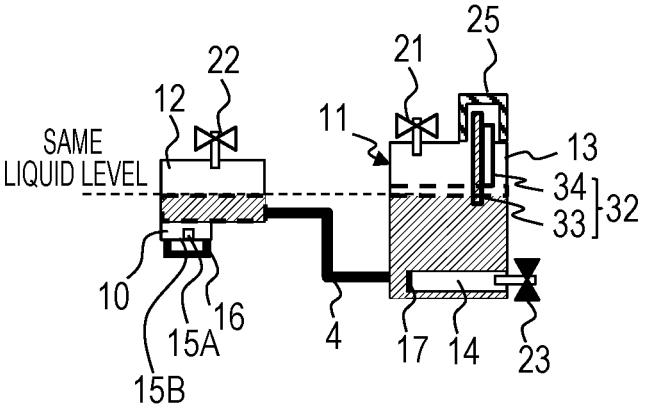
Figure 4D:
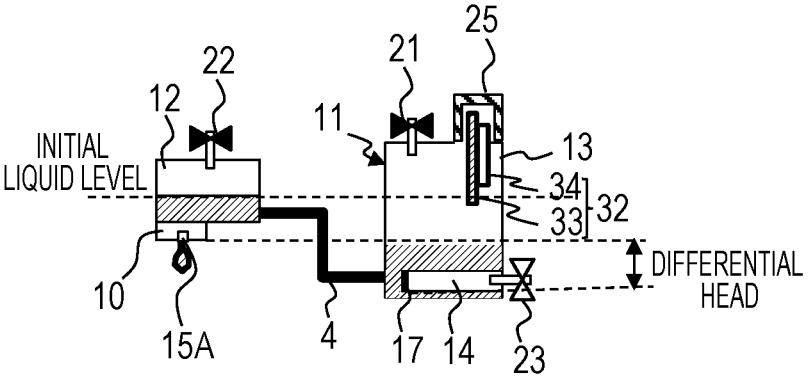

Once the ink filling is terminated, the ink bottle 31 is removed from the joint 32 as illustrated in FIG. 4B, and the ink filling port 28 and the joint 32 are blocked by a first cover 25. Next, as illustrated in FIG. 4C, the first valve 21 and the second valve 22 are opened to open the liquid tank 11 and the sub-tank 12 to the atmosphere, respectively. The ink filled in the liquid tank 11 fills the sub-tank 12 by a hydraulic head pressure generated by the ink in the liquid tank 11. This process is performed similarly to the process described with reference to FIG. 2C of the first embodiment. Next, as illustrated in FIG. 4D, the first and second valves 21 and 22 are closed, and then the third valve 23 is opened. As a result, the pressure of the buffer chamber 14 becomes the atmospheric pressure, a negative pressure is applied to the ejection port 15A, and the recording apparatus 1 becomes ready for printing. This step is performed similarly to the step described with reference to FIG. 2D of the first embodiment.

According to the present embodiment, the ink filling into the liquid tank 11 automatically stops, such that convenience of the user can be improved.

Fourth Embodiment

FIGS. 6A to 6D are each a schematic view illustrating a fourth embodiment of the present invention. A description of the same configuration as that of the first embodiment will be omitted, and a description will be made focusing on differences from the first embodiment. In the present embodiment, the first valve 21 is omitted, and the first atmosphere opening unit is the ink filling port 28 provided in the liquid tank 11. That is, in the present embodiment, the ink filling port 28 also serves as the first atmosphere opening unit 21. Further, a second plug 27 is used in place of the second valve 22 as the second atmosphere opening unit. In the present embodiment, the structure is simplified by these changes.

Figure 6A:
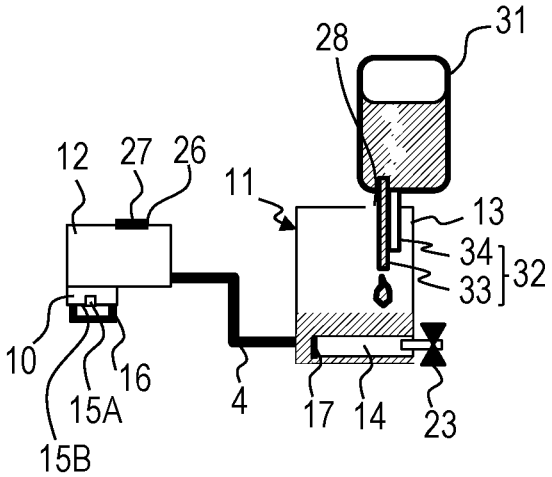
FIGS. 6A, 6B, 6C and 6D are each a schematic view of an ink supply path according to a fourth embodiment of the present invention.

Next, a method for initially filling the sub-tank 12 with ink will be described. When the recording apparatus 1 is started, first, the empty liquid chamber 13 of the liquid tank 11 is filled with the ink as illustrated in FIG. 6A. In the present embodiment, since the same joint 32 as that of the third embodiment is used as the ink filling mechanism, ink filling is performed according to the procedure illustrated in FIGS. 4A and 5A to 5C. However, instead of the illustrated method, the method in which the ink bottle 31 is inserted directly into the ink filling port 28 provided in the upper surface of the liquid tank 11 may be employed as in the first embodiment. A second opening 26 is provided in the upper surface of the sub-tank 12, and the second opening 26 is closed by the second plug 27.

Figure 6B:
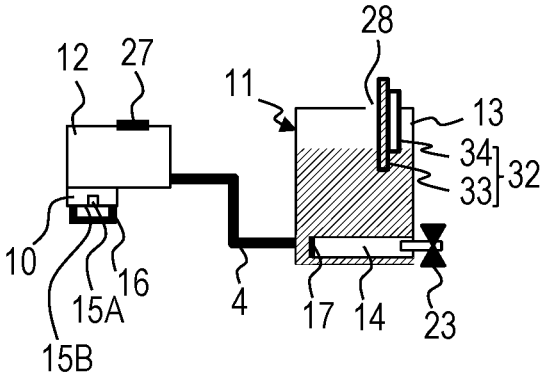
Figure 6C:
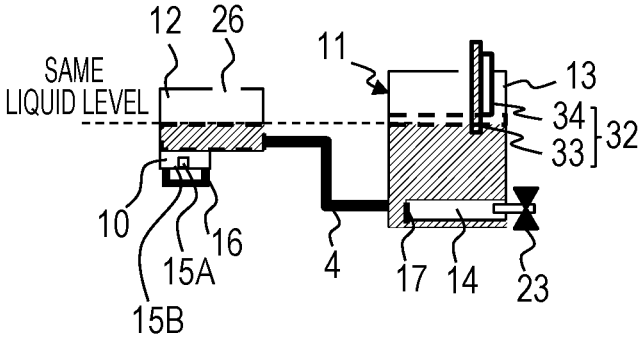
Figure 6D:
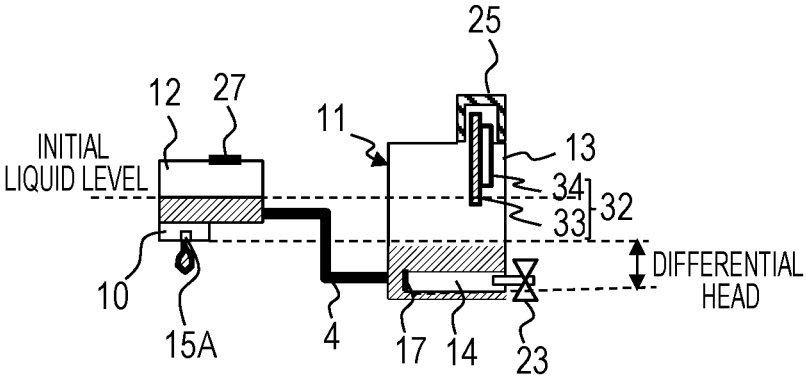

Once the ink filling is terminated, the ink bottle 31 is removed from the joint 32 as illustrated in FIG. 6B. Since the ink filling port 28 remains open, the liquid tank 11 is opened to the atmosphere. Next, as illustrated in FIG. 6C, the second plug 27 is removed, and the sub-tank 12 is opened to the atmosphere. The second plug 27 is most easily removed by the user. The liquid tank 11 and the sub-tank 12 are opened to the atmosphere by the first atmosphere opening unit 21 (ink filling port 28) and the second atmosphere opening unit 22 (second plug 27), respectively. In this state, the ink filled in the liquid tank 11 fills the sub-tank 12 by a hydraulic head pressure generated by the ink in the liquid tank 11. This process is performed similarly to the process described with reference to FIG. 2C of the first embodiment. Next, as illustrated in FIG. 6D, the ink filling port 28 and the joint 32 are covered with the first cover 25, the second opening 26 of the sub-tank 12 is closed by the second plug 27, and then the third valve 23 is opened. As a result, the pressure of the buffer chamber 14 becomes the atmospheric pressure, a negative pressure is applied to the ejection port 15A, and the recording apparatus 1 becomes ready for printing. This step is performed similarly to the step described with reference to FIG. 2D of the first embodiment. The first cover 25 and the second plug 27 are attached before opening the third valve 23. The first cover 25 and the third valve 23 may be operated in an interlocking manner so that only one of them is opened. However, even in this case, the second plug 27 is attached before the third valve 23.

Fifth Embodiment

Figure 7A:
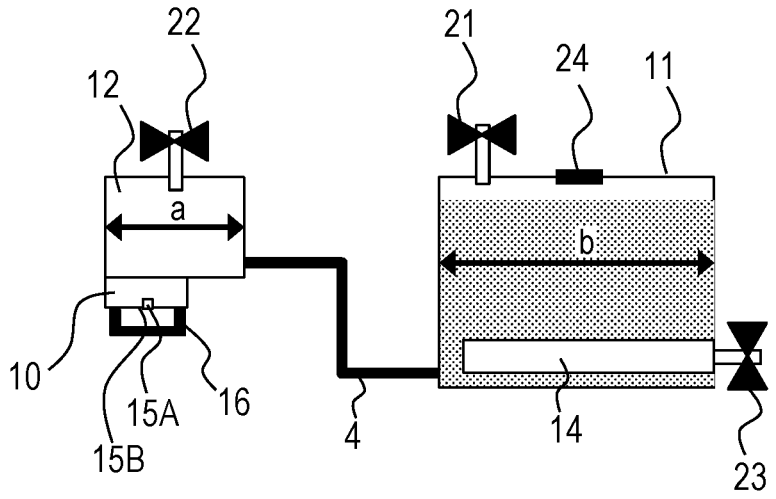
FIGS. 7A and 7B are each a schematic view of an ink supply path according to a fifth embodiment of the present invention.
Figure 7B:
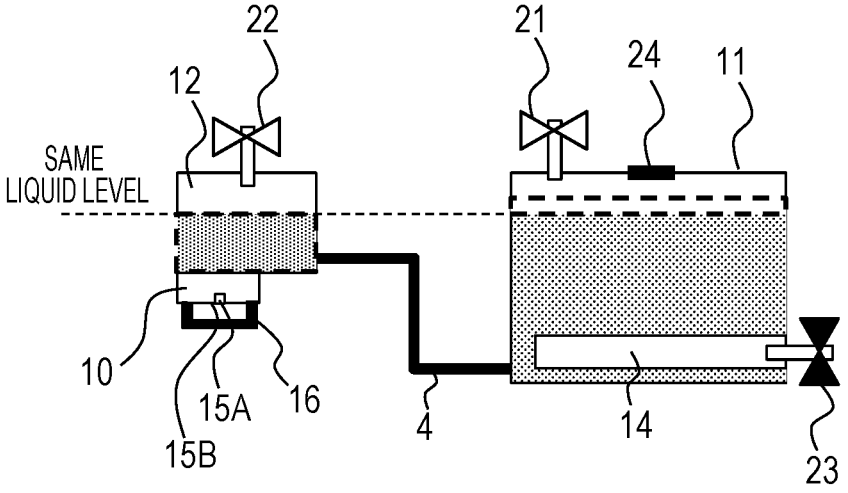

FIGS. 7A and 7B are each a schematic view illustrating a fifth embodiment of the present invention. A description of the same configuration as that of the first embodiment will be omitted, and a description will be made focusing on differences from the first embodiment. FIG. 7A, which is a view corresponding to FIG. 2B, illustrates a state in which ink filling into the liquid tank 11 is completed. FIG. 7B, which is a view corresponding to FIG. 2C, illustrates a state in which the first and second valves 21 and 22 are opened, the ink is transferred to the sub-tank 12, and a liquid level in the liquid tank 11 coincides with a liquid level in the sub-tank 12. In the present embodiment, a cross-sectional area b of the liquid tank 11 in a horizontal direction is larger than a cross-sectional area a of the sub-tank 12 in the horizontal direction. For this reason, a change in the liquid level of the ink in the liquid tank 11 at the time of filling the sub-tank 12 with the ink becomes small. As a result, the liquid tank 11 can have a small height, and thus the recording apparatus 1 can have a small height. The larger the ratio b/a of the cross-sectional area b of the liquid tank 11 to the cross-sectional area a of the sub-tank 12 is, the larger the effect is. For example, the ratio b/a is preferably 2 or more.

Sixth Embodiment

Figure 8A:
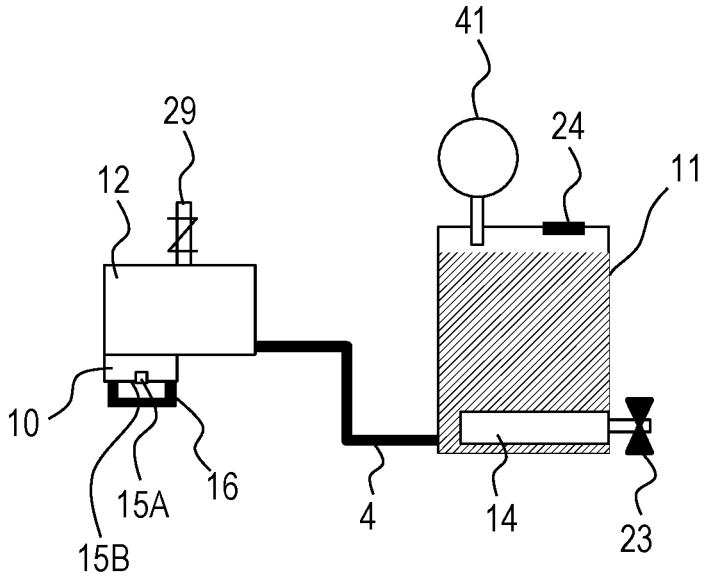
FIGS. 8A and 8B are each a schematic view of an ink supply path according to a sixth embodiment of the present invention.
Figure 8B:
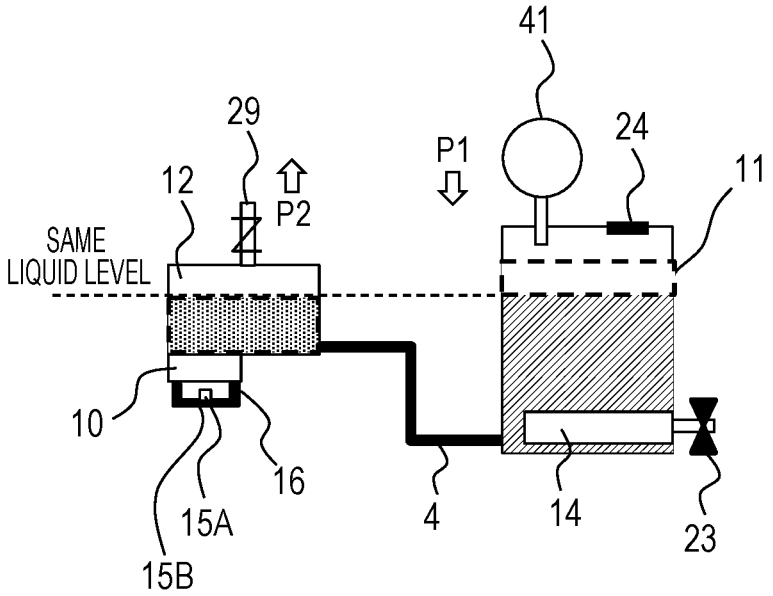

FIGS. 8A and 8B are each a schematic view illustrating a sixth embodiment of the present invention, and illustrate an initial ink filling process in a time-series manner, similarly to FIG. 3. A description of the same configuration as that of the first embodiment will be omitted, and a description will be made focusing on differences from the first embodiment. In the present embodiment, a first pressurization unit 41 is provided on the upper surface of the liquid chamber 13 of the liquid tank 11 in place of the first atmosphere opening unit 21. The first pressurization unit 41 can be implemented by, for example, a pump. A tube or a pipe (not illustrated) connected to an ejection portion of the pump is connected to an upper space of the liquid tank 11. The second atmosphere opening unit is a check valve 29 that is opened by an opening pressure P2 smaller than a pressurizing pressure P1 of the first pressurization unit 41.

Next, a method for initially filling the sub-tank 12 with ink will be described. When the recording apparatus 1 is started, first, the empty liquid chamber 13 of the liquid tank 11 is filled with the ink as illustrated in FIG. 8A. Since the check valve 29 of the sub-tank 12 is closed, the ink does not move to the sub-tank 12 at this point of time as in the first embodiment. Next, as illustrated in FIG. 8B, a pressure in the liquid tank 11 is increased to the pressurizing pressure P1 by the first pressurization unit 41. As a result, the check valve 29 is opened, the sub-tank 12 is opened to the atmosphere, and the air in the sub-tank 12 is exhausted from the sub-tank 12. Therefore, the ink in the liquid tank 11 moves to the sub-tank 12 by a pressurizing force applied by the first pressurization unit 41. When the ink in the sub-tank 12 reaches a predetermined filling amount, the first pressurization unit 41 is stopped. As a result, the check valve 29 is closed. A sensor or a timer can be used for controlling the first pressurization unit. Thereafter, the third valve 23 is opened. This step is performed similarly to the step described with reference to FIG. 2D of the first embodiment.

The pressurizing pressure P1 of the pressurization unit is appropriately set to be in balance with the opening pressure P2 of the check valve 29. In the present embodiment, it is preferable that a vibration pressure generated in the sub-tank 12 due to movement of the tube 4 is further taken into consideration. Since the recording apparatus 1 uses the movable carriage 2, the vibration pressure is generated in the sub-tank 12 due to the movement of the tube 4 resulting from the movement of the carriage 2 during printing. Specifically, an inner portion of the sub-tank 12 is pressurized when the carriage 2 moves in a direction (a direction B in FIG. 1) to push the tube 4. According to a measurement result obtained by experiments, the vibration pressure is generally in a range of 100 to 500 mmAq (1 to 5 KPa). The opening pressure P2 of the check valve 29 is set so that the check valve 29 is not opened by the vibration pressure. Further, the pressurizing pressure P1 needs to be larger than the opening pressure P2 of the check valve 29. That is, the opening pressure P2 of the second valve 22 is preferably set to a value larger than the vibration pressure generated in the sub-tank 12 due to the movement of the tube 4 and smaller than the pressurizing pressure P1 of the first pressurization unit. For example, in a case where the opening pressure P2 of the check valve 29 is set to 10 KPa or more and the pressurizing pressure P1 is set to 50 KPa or more, the opening pressure P2 of the check valve 29 is preferably set in a range of 10 KPa≤P2<50 KPa.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-048488, filed Mar. 15, 2019, which is hereby incorporated by reference herein in its entirety.

What is claimed is:

1. A liquid ejection apparatus comprising:

a recording head that ejects liquid;

a sub-tank that is connected to the recording head and temporarily stores the liquid to be supplied to the recording head;

a liquid tank that communicates with the sub-tank and is able to be filled with the liquid;

a first atmosphere opening unit that is provided in the liquid tank; and a second atmosphere opening unit that is provided in the sub-tank, wherein the second atmosphere opening unit is configured to be closable when the liquid tank is filled with the liquid, and the first atmosphere opening unit and the second atmosphere opening unit are configured to be able to open the liquid tank and the sub-tank to atmosphere, respectively, when the sub-tank is filled with the liquid filled in the liquid tank by a hydraulic head pressure, and a joint that passes through a liquid filling port provided in the liquid tank, wherein the joint communicates with an external liquid filling unit during filling with the liquid and includes a liquid inflow path through which the liquid flows into the liquid tank and an air exhaust path through which air inside the liquid tank is exhausted, and an upper surface of the sub-tank is at a position higher than a lower end of the air exhaust path.

2. The liquid ejection apparatus according to claim 1, wherein the first atmosphere opening unit is a first valve provided in the liquid tank.

3. The liquid ejection apparatus according to claim 1, wherein the recording head has an ejection port forming surface in which an ejection port from which the liquid is ejected is formed, the liquid tank includes a liquid chamber in which the liquid is stored, a buffer chamber connected to the liquid chamber through a gas-liquid exchange port which interrupts a flow of the liquid and through which propagation of pressure is permitted, and a third atmosphere opening unit provided in the buffer chamber, and a bottom portion of the gas-liquid exchange port is located on a level lower than a level of the ejection port forming surface.

4. The liquid ejection apparatus according to claim 1, wherein an upper surface of the liquid tank is lower than a maximum liquid filling height of the sub-tank or an upper surface of the sub-tank.

5. The liquid ejection apparatus according to claim 1, wherein a cross-sectional area of the liquid tank in a horizontal direction is larger than a cross-sectional area of the sub-tank in the horizontal direction.

6. A liquid filling method for a liquid ejection apparatus including a recording head that ejects liquid, a sub-tank that is connected to the recording head and temporarily stores the liquid to be supplied to the recording head, a liquid tank that communicates with the sub-tank and is able to be filled with the liquid from outside, a first atmosphere opening unit that is provided in the liquid tank, and a second atmosphere opening unit that is provided in the sub-tank, the liquid filling method comprising:

filling the liquid tank with the liquid to a level higher than a bottom surface of the sub-tank in a state in which the second atmosphere opening unit is closed; and filling the sub-tank with the liquid filled in the liquid tank by a hydraulic head pressure in a state in which the first atmosphere opening unit and the second atmosphere opening unit open the liquid tank and the sub-tank to atmosphere, respectively.

7. The liquid filling method according to claim 6, wherein the recording head has an ejection port forming surface in which an ejection port from which the liquid is ejected is formed, the liquid tank includes a liquid chamber in which the liquid is stored, a buffer chamber connected to the liquid chamber through a gas-liquid exchange port and positioned on a level lower than a level of the ejection port forming surface, the gas-liquid exchange port interrupting a flow of the liquid and through which propagation of pressure is permitted, and a third atmosphere opening unit provided in the buffer chamber, a bottom portion of the gas-liquid exchange port is located on a level lower than a level of the ejection port forming surface, and the first and second atmosphere opening units are closed after the sub-tank is filled with the liquid and subsequently, the third atmosphere opening unit is opened.

* * * * *